United States Patent [19]

Ushio et al.

[11] Patent Number: 4,853,740

[45] Date of Patent: Aug. 1, 1989

[54] RECORDING APPARATUS CAPABLE OF MULTIPLE RECORDING ON ONE OR BOTH SIDES OF A SHEET

[75] Inventors: Yukihide Ushio; Hiroshi Hashimoto, both of Tokyo; Kenjiro Hori, Yokohama; Kaoru Seto, Chigasaki; Toshio Yoshimoto, Tokyo, all of Japan

[73] Assignee: Canon Kabushiki Kaisha, Tokyo, Japan

[21] Appl. No.: 245,964

[22] Filed: Sep. 16, 1988

Related U.S. Application Data

[63] Continuation of Ser. No. 601,177, Jan. 7, 1987, abandoned.

[30] Foreign Application Priority Data

Jan. 10, 1986 [JP] Japan ..... 61-2236
Jan. 10, 1986 [JP] Japan ..... 61-2237

[51] Int. Cl.[4] ..... G03G 15/00

[52] U.S. Cl. ..... 355/319; 355/24; 355/321

[58] Field of Search ..... 355/3 SH, 14 SH, 14 R, 355/24; 271/3.1, 110, 111, 301; 358/296, 302, 300

[56] References Cited

U.S. PATENT DOCUMENTS

| | | | |
|---|---|---|---|
| 4,350,439 | 9/1982 | Tanioka et al. | 355/3 SH X |
| 4,488,801 | 12/1984 | Gibson | 355/24 |
| 4,524,394 | 6/1985 | Nagashima | 358/296 |
| 4,568,169 | 2/1986 | Wada et al. | 355/14 SH X |
| 4,573,789 | 3/1986 | Wada | 355/14 SH |
| 4,589,765 | 5/1986 | Perun et al. | 271/265 X |

OTHER PUBLICATIONS

IBM Technical Disclosure Bulletin, vol. 24, No. 1B, Jun. 1981, Janssen et al.

*Primary Examiner*—A. C. Prescott
*Attorney, Agent, or Firm*—Fitzpatrick, Cella, Harper & Scinto

[57] ABSTRACT

There is disclosed a sheet feeder for multiple image recording on one or both sides of a sheet. A first sheet feeding mechanism feeds the sheets to a recording station, while a second sheet feeding mechanism refeeds the recorded sheet for second recording, and a control unit regulates the interval of sheet feeding according to the state of the second feeding mechanism, in order to achieve efficient sheet feeding.

13 Claims, 4 Drawing Sheets

RECORDING APPARATUS CAPABLE OF MULTIPLE RECORDING ON ONE OR BOTH SIDES OF A SHEET

This application is a continuation of application Ser. No. 001,177 filed Jan. 7, 1987 now abandoned.

BACKGROUND OF THE INVENTION

1. Field of the Invention

The present invention relates to a recording apparatus capable of multiple recording on one side or both sides of a sheet member.

2. Related Background Art

A feedback sheet transport mechanism, conventionally employed for two-side printing operation, performs an operation of bringing a print sheet, after printing on one face thereof, again to a print enabled state together with an operation of inverting the print sheet, or an operation of the image bearing face of thus already printed sheet again to the print enabled state without sheet inversion, thereby achieving multiple print in which plural prints are made on a same face of the sheet. Such sheet inversion has been achieved by stacking the sheets on an intermediate tray and re-feeding said sheets again from said tray, but such stacking and refeeding cannot be conducted simultaneously. When a printer performs a continuous two-side printing operation with a maximum throughput represented by a maximum number of prints per minute, the sheets printed on one faces thereof will be transported to the intermediate tray with said speed. On the other hand, since the intermediate tray cannot simultaneously perform the stacking of the print sheets and the refeeding thereof, it has to preferentially stack the print sheet fed from the upstream side and to conduct the refeeding of the print sheets, in interim periods, for transfer to the printer, in order to avoid sheet jamming.

On the other hand, the sheet refeeding operation cannot be interrupted once it is started. Consequently such refeeding operation has to be completed within a period from the completion of a preceding stacking operation to the start of a succeeding stacking operation. Situation is substantially same in a multiple printing operation. More specifically the refeeding has to be conducted, from the completion of a preceding stacking operation, within a period equal to the sum of a time corresponding to the sheet size and a time corresponding to the interval of the sheets.

However, in a situation where a relation:

$$t_s > (t_0 + t_1) \quad (1)$$

stands, wherein $t_s$ is the stacking time of the intermediate tray, while $t_0$ is the time corresponding to the sheet size acceptable in the printer, and $t_1$ is the time corresponding to the interval between the sheets, the intermediate tray can only conduct the stacking operation and will eventually overflow, so that the two-side printing operation can never be achieved, and the maximum throughput, determined by the stacking time $t_s$ of the intermediate tray, is reduced.

On the other hand, in a situation where a relation:

$$t_s < (t_0 + t_1) \quad (2)$$

stand, the number of sheets discharged to the intermediate tray exceeds that of sheets fed therefrom unless the interval of re-fed sheets is equal to that of the sheets supplied from the printer, so that the interval of the print sheets fed from the feedback transport mechanism becomes inevitably longer. Thus there may result an inconvenience that the recording apparatus, of a lower hierarchy in a system, may govern the operation of an external equipment of a higher hierarchy.

Also in a situation where said relation (2) stands, in addition of elongation of the interval of the re-fed sheets in comparison with the interval of sheets supplied to the intermediate tray, the number of sheets supplied to the intermediate tray significantly exceeds the number of sheet refed therefrom if two-side continuous printing operation is continued, eventually causing an overflow and sheet jamming in the intermediate tray.

Furthermore, because of the limitation that the intermediate tray cannot simultaneously effect the stacking of the printing sheets and the sheet feeding, a random sheet feeding from the feedback transport mechanism or a sheet source is not possible and the throughput is therefore significantly lowered.

SUMMARY OF THE INVENTION

In consideration of the foregoing, an object of the present invention is to provide an improved printing apparatus capable of two-side or multiple recording.

Another object of the present invention is to provide a recording apparatus capable of preventing a loss in the throughput in the continuous printing operation.

Still another object of the present invention is to provide a recording apparatus capable of random sheet supply from plural sheet sources without a loss in the throughput.

Still another object of the present invention is to provide a recording apparatus capable of controlling the interval of sheet feeding according to the operation status.

Still another object of the present invention is to provide a recording apparatus capable of controlling the interval of refeeding of sheets according to the operation status.

The foregoing and still other objects of the present invention will become fully apparent from the following description which is to be taken in conjunction with the attached drawings.

DETAILED DESCRIPTION OF THE PREFERRED EMBODIMENTS

Figure 1:
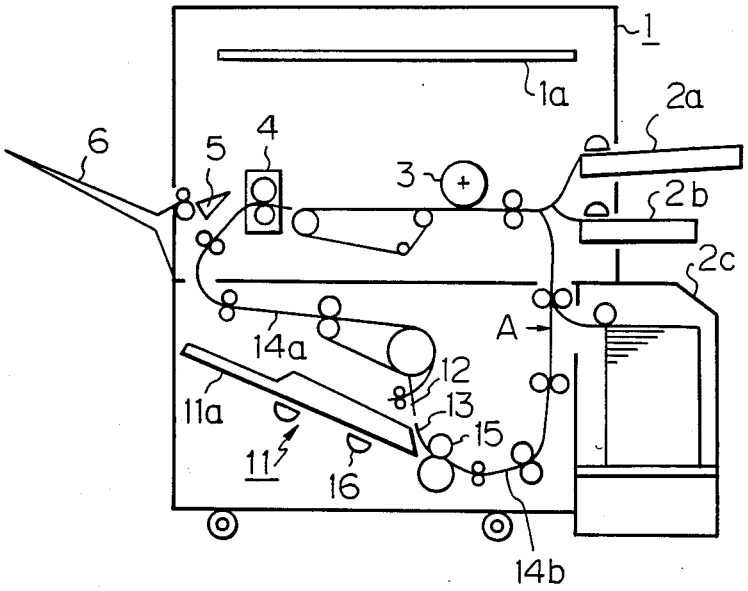
FIG. 1 is a schematic cross-sectional view of a recording apparatus embodying the present invention.

FIG. 1 is a schematic cross-sectional view of a recording apparatus embodying the present invention, wherein shown are a printer 1 of which various units are controlled by a control unit 1*a* which also functions as transport control means; sheet feed units 2*a*–2*c* housing sheet members or print sheets; a photosensitive drum 3 on which an image is formed with an unrepresented optical system through a known electrophotographic process and is transferred onto a print sheet by means of an unrepresented transfer charger; a fixing unit 4 for fixing the image transferred onto the print sheet; a flapper 5 for controlling the direction of transported sheet; and a discharged sheet tray 6 on which print sheets bearing printed images are stacked.

A two-side unit 11 is composed of an intermediate tray 11*a* for inverting the print sheets transported downwards by the flapper 5, two-side transport paths 14*a*, 14*b* etc. The intermediate tray 11*a* is associated with a sensor 12 for detecting the presence of stacked print sheets thereon, and a movable member 13 for enabling smooth refeeding of the sheets supplied to the intermediate tray. Said two-side transport paths 14*a*, 14*b* constitute a feedback transport path. The print sheet is transported, through the two-side transport path 14*a*, intermediate tray 11*a* and two-side transport path 14*b*, to the photosensitive drum 3. A refeed roller 15 feeds the print sheet placed on the intermediate tray 11*a* to the two-side transport path 14*b* under the control of the control unit 1*a*. The sheet once stops at a position A, and fed again in synchronization with the image forming unit. D-shaped rollers 16 transport the print sheet, placed on the intermediate tray 11*a*, to the position of the refeed roller 15. The two-side unit 11 is made detachable from the printer.

Figure 2:
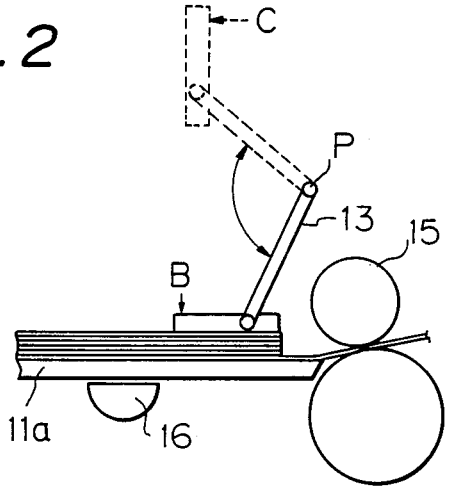
FIG. 2 is a partial enlarged view of the apparatus shown in FIG. 1.

FIG. 2 is a partial enlarged view of FIG. 1, wherein same components as those in FIG. 1 are represented by same numbers. A member 13, movable about a shaft P, moves to a position C during the storage of the print sheets transported from the two-side transport path 14 *a* to the intermediate tray 11*a*, and moves to a position B for pressing the print sheets downwards during the refeeding of the print sheets from the intermediate tray 11*a*.

In response to an instruction from an external equipment to the control unit 1*a* of the printer 1, a print sheet is fed from one of the sheet feed units 2*a*–2*c*. In case of printing with a maximum throughput, a succeeding print sheet is fed after a time corresponding to the size of the print sheet plus a predetermined interval time. Subsequently a toner image formed on the photosensitive drum 3 is transferred onto thus fed print sheet and is fixed thereon in the fixing unit 4. In this manner the formation of an image on a side of the print sheet is completed. After such image formation on one side, the print sheet is guided, for two-side printing, to the two-side transport path 14 *a* by the flapper 5. The sheet then crosses the sensor 12 and is temporarily stacked on the intermediate tray. After said stacking, the sheet is fed again to the two-side transport path 14*b* by the refeed roller 15, and is stopped at the position A, an operation called "set-up". An instruction from the external equipment is awaited in this state. In case of a relatively small sheet size, not exceeding A4 size, a succeeding sheet has to be fed to the two-side transport path 14*b* by the refeed roller 15, in order to maintain a predetermined sheet interval. In practice, however, said interval is extended because the intermediate tray 11*a* enters the sheet stacking operation instead of sheet refeeding.

In the present embodiment, a loss in the throughput is prevented by the control of sheet feed timing from the feed units 2*a*–2*c* or from the intermediate tray 11*a*.

Figure 3:
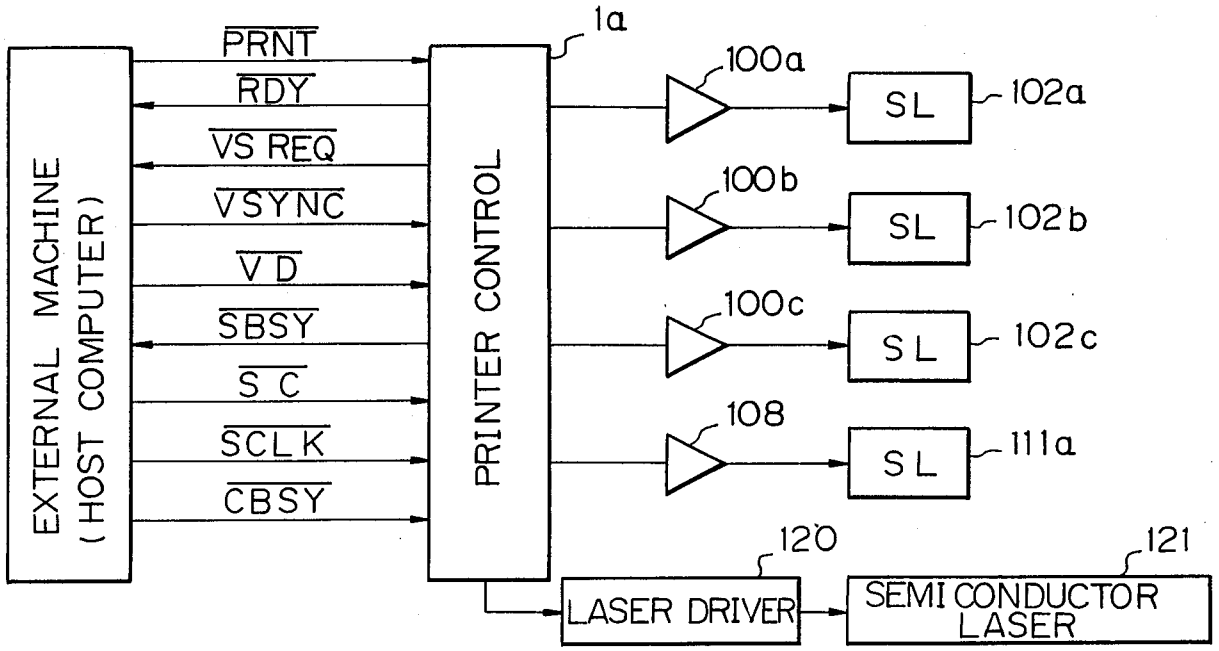
FIG. 3 is a block diagram of the recording apparatus sown in FIG. 1 and an external equipment.
Figure 4:
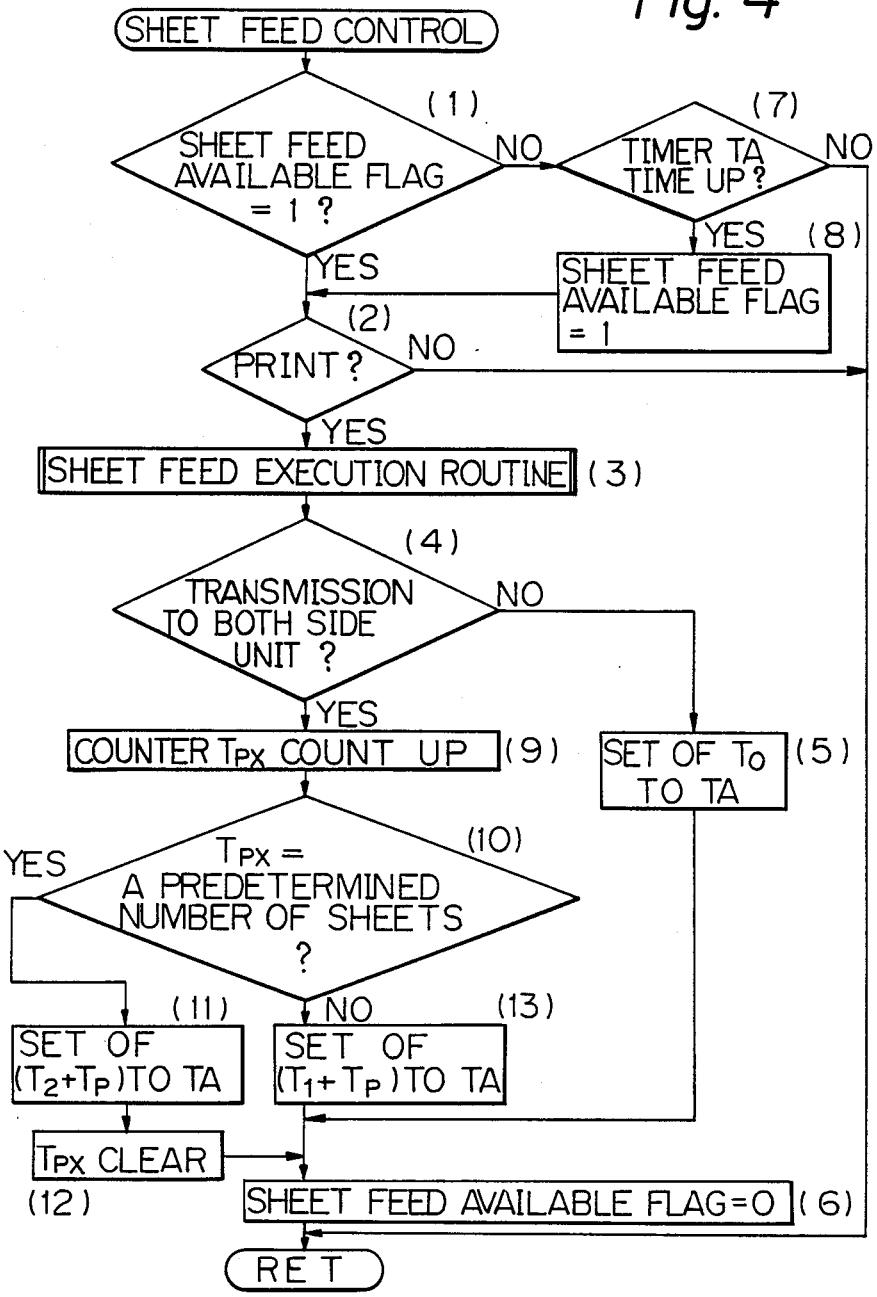
FIGS. 4 and 5 are flow charts showing an example of the print sheet feed control constituting an embodiment of the present invention.
Figure 5:
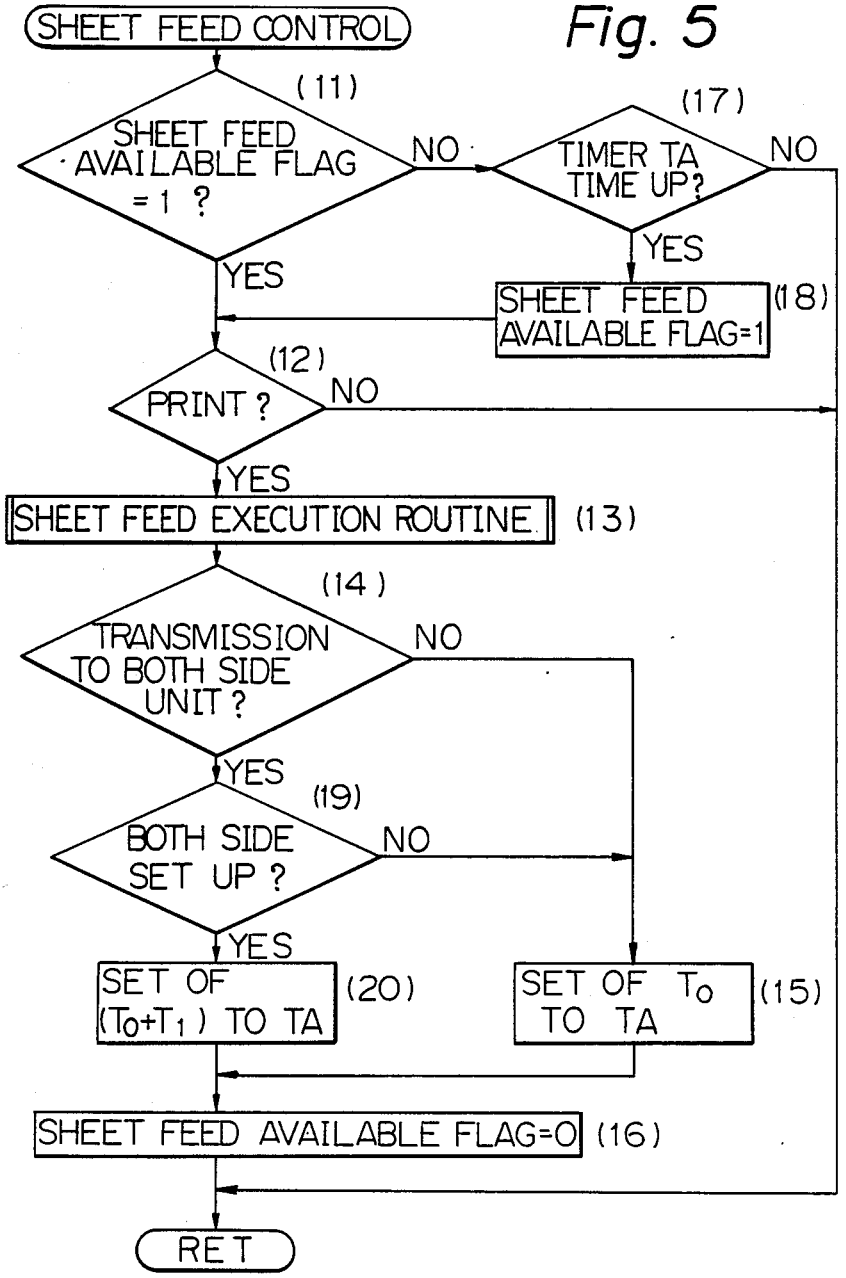

FIG. 3 is a block diagram of a control unit for such control, and FIGS. 4 and 5 are flow charts showing the control sequence of said control.

In FIG. 3, there are shown solenoids 102*a*–102*c* for driving rollers for sheet feeding from the sheet feed units 2*a*–2*c*; drivers 100*a*–100*c* for activating said solenoids 102*a*–102*c*; a solenoid 111*a* for driving the refeed roller 15*a* for sheet feeding from the intermediate tray 11*a*; a driver 101 for activating said solenoid 111*a*; a semiconductor laser 121 for irradiating the photosensitive drum 3; a laser driver 120 for driving said semiconductor laser 120; and an external equipment or a host computer 200, which supplies the printer control unit la with a PRINT signal, a VSYNC signal, a VD signal and an SC signal, and receiving a RDY signal, a USREQ signal etc. from said printer control unit 1*a*. Signals not directly related to the present invention are omitted. In the following there will be explained the above-mentioned signals.

The signal RDY indicates a state capable of starting a print operation when the printer 1 receives a signal PRNT to be explained later from the external equipment, and assumes a low-level state "1" when the sheet feed units 2*a*–2*c* do not contain print sheet.

The signal PRNT is utilized by the external equipment for instructing the printer 1 to start an image forming operation, or indicates a state of image formation if such image formation is in progress.

The signal VSREQ indicates a state the high-level state "1" of said signal RDY and PRNT, whereby the printer 1 is ready for receiving a signal VSYNC to be explained later.

The signal VSYNC is a synchronization signal in the vertical direction (sub-scan direction) of the printed image and is utilized by the external equipment to cause the printer to synchronize the front end of the image on the photosensitive drum 3 with the print sheet.

The signal VDO is an image signal released by the external equipment, and the printer 1 performs image formation by forming black or white respectively in response to "1" (high level) or "0" (low level) of said signal.

The signal SC is a bidirectional 8-bit serial signal utilized as a command signal from the external equipment to the printer 1 or a status signal from the printer 1 to the external equipment, and is fetched by said external equipment or said printer 1 by means of a clock signal SCLK to be explained later. As it is a bidirectional signal, the input-output control is achieved by signals SBSY and CBSY to be explained later. The command signal is an 8-bit serial signal, for example including a command for sheet supply from the unit 2c or from the intermediate tray 11a.

The status signal is an 8-bit serial signal, for example indicating a waiting state in which the fixing unit has not reached a predetermined temperature for printing, a sheet jamming, or absence of sheets in the feed units 2a–2c.

The signal SCLK is a synchronization clock pulse signal utilized by the printer 1 for fetching the command signal or by the external equipment 1 for fetching the status signal.

The signal SBSY is utilized for occupying signal lines SC and SCLK prior to the transmission of the status signal by the printer 1.

The signal CBSY is utilized for occupying signal lines SC and SCLK prior to the transmission of the command signal by the external equipment.

In the following there will be explained the mutual relationship of the printer 1 and the external equipment.

When an unrepresented power switch of the printer and a power switch of the external equipment are closed, the printer 1 performs an initialization. Also the external equipment likewise performs initialization. The printer supplies the signal RDY to the external equipment when it becomes operable, for example when the surface temperature of the fixing roller reaches a predetermined value suitable for fixing.

In response the external equipment transmits the signal PRNT to the printer 1 when required. In response to said signal, the printer 1 rotates the photosensitive drum 3 for obtaining uniform potential thereon, and activates a sheet feed roller for example of the feed unit 2c to advance the front end of a print sheet to an unrepresented registration shutter of registration rollers 22. The printer transmits a signal VSREQ to the external equipment when it becomes ready for receiving the image signal VDO.

In response to said signal VSREQ, the external equipment supplies the signal VSYNC to the printer 1. In synchronization with said signal VSYNC, the printer 1 activates the registration shutter, thus opening the transport path. Subsequently, in synchronization with the horizontal synchronization signal BD from the printer 1, the external equipment supplies the printer with sequential image signal VDO to be recorded. The laser driver 120 performs on-off control of the semiconductor laser 121 according to said image signal VDO, whereby a latent image is formed on the photosensitive drum 3 and is rendered visible by toner deposition in an unrepresented developing unit. The developed image is transferred onto the transported print sheet and is fixed thereon by fixing rollers 4.

Now reference is made to FIG. 4 for explain the sheet feed control embodying the present invention, wherein the sheet feed timing of the feed units 2a–2c is controlled according to the number of sheets transported to the intermediate tray. The flow shown in FIG. 4 has steps (1) to (13) and is called at a regular interval by the control unit 1a shown in FIGS. 1 and 3.

When the sheet feed control flow is called, a sheet feed enable flag is checked to identify if a sheet feeding operation is enabled (flag=1) (1). If this discrimination turns out affirmative (it is automatically affirmative at the start of printing), the ready conditions of the printer 1 are checked (printer is immediately operable if there are no errors), and the intention for printing is checked by the signal PRNT from the external equipment (2). If the discrimination turns out negative, i.e. if the printer is not ready or if the external equipment has no intention for printing, the control sequence is terminated. On the other hand, in case of an affirmative discrimination, there is started a sheet feed routine for a feeding unit, for example 2c, designated by the signal SC from the external equipment etc. (3). In said routine, the time $T_p$ is determined according to the size of the print sheet. Then there is discriminated, from the signal SC, whether the fed print sheet has been transported to the two-side unit 11 (4), and, if not, an unrepresented timer TA is started with a time $T_0$ to be explained later (5), then the sheet feed enable flag is shifted to "0" and the sequence is terminated. Said flag "0" indicates a sheet feed disabled state. The timer TA counts a time proportional to the set value, and indicates whether said counting is still in progress or has been completed.

On the other hand, if the discrimination in the step (1) in said flow turns out negative, there is discriminated whether the counting operation of the timer TA has been completed (7), and, if negative, the control sequence is terminated (the steps (1) and (6) are repeated until the lapse of a predetermined period after the feeding of a preceding print sheet). On the other hand, if said discrimination turns out affirmative, the sheet feed enable flag is set to "1" (8) and program returns to the step (2) whereby a sheet feeding operation is conducted according to the command of the external equipment.

The above-explained procedure is repeated to achieve a one-side continuous print operation with a throughput (number of prints per minute) desired by the external equipment. However the maximum throughput is determined by the printing operation specific to the printer 1, and can be achieved by setting, in said timer TA, a time $T_0$ defined by the following equation (3):

$$T_0 = T_p + T_x \quad (3)$$

wherein $T_p$ is a time corresponding to the size of the print sheet, and $T_x$ is a time corresponding to an interval between the sheets for achieving the maximum throughput. In case of one-side printing operation, the succeeding sheet becomes available for feeding after said time $T_0$, and the maximum throughput can be achieved if the control unit 1a performs a control according to such timing under the control of the external equipment.

On the other hand, if the discrimination in the step (4) turns out affirmative, i.e. in case of a two-side print operation, a counter $T_{px}$ for counting the number of print sheets supplied to the two-side transport path 14 is activated (9), and a discrimination is made whether said counter $T_{px}$ has reached a predetermined number, corresponding to the predetermined number of stacking on the intermediate tray 11a (10). If said discrimination turns out affirmative, a count time $T_2$ (corresponding to the extended sheet interval at maximum throughput, as will be explained later)$+T_p$ is set on the timer TA (11), then the counter $T_{px}$ is cleared (12) and the program returns to the step (8). On the other hand, if said discrimination turns out negative, a count time $T_1$ (corresponding to a sheet interval smaller than for the maximum throughput, as will be explained later)$+T_p$ is set on the timer TA (13), and the program returns to the step (6) to repeat the operation in the same manner as in the one-side printing operation.

In this manner, in the two-side print operation, the time from the completion of sheet stacking on the intermediate tray 11*a* to the start of sheet refeeding therefrom is regulated at the initial sheet feeding. More specifically, the time $T_2$ is set to a sheet interval corresponding to a time $T_s$ required for the intermediate tray 11*a*. Also the extention of time by $T_2$ in comparison with the aforementioned $T_x$ can be compensated by $T_1$, so that the maximum throughput is not decreased. Thus $T_1$ is so determined as to satisfy the following equation (4):

$$T_s=T_2=(T_x-T_1)\times(T_{px}-1) \quad (4)$$

As an example, for conditions of $T_s=1$ sec, $T_x=0.7$ sec and $T_{px}=5$ sheets or less, the parameters can be selected as:

$T_1=0.45$ sec, $T_2=1$ sec, and $T_{px}=5$ sheets; or $T_1=0.2$ sec, $T_2=1$ sec, and $T_{px}=3$ sheets to achieve, also in the two-side printing operation, a throughput same as in a continuous print operation with a sheet interval of a time $T_x$, which is determined by the performance of the printer 1 itself.

Also the parameters $T_1$ and $T_2$ can be maintained constant regardless of the sheet size.

In the foregoing embodiment the sheet interval is increased or decreased according to the number of sheet transported to the two-side transport path 14*a*, but it is also possible to effect such increase or decrease for example according to a signal from a sensor.

Also in the foregoing embodiment the sheet feed control is achieved under a condition set in the timer TA in advance, but it is also possible to regulate the set value of said timer TA according to the size of the print sheet, or to effect an operation same as in the one-side printing, if the predetermined sheet interval $T_x$ is optimum for a certain sheet size. In such case the parameters $T_1$ and $T_2$ may be selected as 0 second.

Furthermore, in the foregoing explanation the interval of the print sheets is regulated due to a limitation in the intermediate tray 11*a* of the two-side unit 11, but the present invention is applicable to a case where the sheet interval has to be regulated according to a limitation imposed by sheet discharge means outside the printer, for example a sorter connectable to the printer.

Furthermore, though the foregoing embodiment is limited to a two-side print operation, a similar process is naturally applicable to a multiple print operation.

FIG. 5 is a flow chart showing another embodiment of the sheet feed control, in which the feed timing of a print sheet is controlled according to whether a preceding print sheet has been transported to the set-up position A of the two-side unit.

Said flow, comprising steps (11)–(20), is called at a regular interval by the control unit 1*a* shown in FIGS. 1 and 3.

When the sheet feed control of a first mode (one-side print mode) is designated, the sheet feed enable flag is checked to discriminate whether the sheet feeding is enable (flag=1) (11). If said discrimination turns out affirmative (automatically affirmative at the start of a print operation), the ready condition of the printer is checked, and the presence of request for printing is discriminated from the signal PRNT from the external equipment (12). If said discrimination turns out negative, i.e. if the printer is not ready or if not request is given from the external equipment, the control sequence is terminated. On the other hand, if said discrimination is affirmative, a sheet feeding operation is conducted for example from a feed unit 2*a* designated by the signal SC from the external equipment, and there is executed a sheet feed routine for determining the time parameters $T_0$, $T_1$ according to the size of the print sheet as will be explained later (13). Consequently said parameters $T_0$, $T_1$ are determined for each fed sheet. Then a discrimination is made, from the signal SC, whether the fed sheet is transported to the two-side unit (14). If the result is negative, a time $T_0$, to be explained later, is unconditionally set in the unrepresented time TA (15), then said timer is started, and the sheet feed enable flag is shifted to "0", and the control sequence is terminated (16). Said "0" flag indicates a state where the sheet feeding is disabled. The timer TA counts a time proportional to the set value, and indicates whether the counting operation is in progress or has been completed. Said time $T_1$ may be substantially equal to zero.

On the other hand, if the discrimination in the step (11) of said flow in FIG. 5 is negative, a discrimination is made as to whether the counting operation of the timer TA has been completed (17), and, if not, the control sequence is terminated (steps (11) and (18) are repeated during a predetermined time after the feeding of the preceding print sheet). On the other hand, if the result is affirmative, the sheet feed enable flag is set to "1" (18), and the program returns to the step (12) for effecting the sheet feeding under the control of the external equipment.

A continuous one-side print operation can be executed with a desired throughput, or a desired number of sheets per minute, under the control of the external equipment by repeating the above-explained procedure. However, the maximum throughput is determined by the printing performance of the printer 1, and can be achieved by setting a time $T_0$ satisfying the foregoing relation (3) into the timer TA. Thus, in the one-side print operation, a succeeding print sheet becomes available for feeding after said time $T_0$, and the continuous print operation with the maximum throughput can be achieved by the control unit 1*a* with such timing, under the instruction from the external equipment.

On the other hand, if the discrimination in the step (14) turns out affirmative, i.e. in a second mode for two-side printing, there is discriminated whether a print sheet, bearing an image on one side and supplied from the intermediate tray 11*a* with inversion, has been set up at the position A on the two-side transport path 14*b* (19), and, if not, the program returns to the step (15). On the other hand, if the result is affirmative, a time $T_1$ obtained in the step (13) plus the time $T_0$ is set on the timer TA (20), and the program returns to the step (16) to effect an operation same as in the one-side print operation.

In this manner the sheet feeding from the intermediate tray 11*a* is conducted at a timing delayed from that for the maximum throughput, and the sheet feed timing after the position A is controlled by the parameter $T_0$. The set-up completion state is latched until the completion of the printing operation.

Consequently the interval of the print sheet supplied from the intermediate tray is extended by $T_1$ until the printing operation on the rear side is enabled, and then returns to the interval corresponding to the maximum throughput until the completion of the printing operation.

Said time $T_1$ can be selected equal to the time from the start of sheet refeeding from the intermediate tray 11*a* to the transfer of the print sheet to the refeeding roller 15. More specifically, a first print sheet, supplied from the two-side transport path 14*a* and stacked on the intermediate tray 11*a* , is refed before a next print sheet is stacked. Also the second print sheet is promptly refed before the start of stacking of a third print sheet, follows the first print sheet and stops at a position of a sheet interval giving the maximum throughput.

Therefore, once the print sheet for two-side print is brought to the set-up state, two-side printing is achieved with the maximum throughput under the control of the external equipment. However the sheet feeding is not limited to the feed unit 2*a*–2*c* or the two-side transport path 14*b*, but may be conducted from both in random manner, so that the print sheets with one-side print and two-side print are discharged in mixed state and with the maximum throughput.

The set-up position, which is selected at A in FIG. 1 in the foregoing embodiment, may be positioned in either of the two-side transport paths 14*a*, 14*b* or any position in the printer.

In the foregoing embodiment the set-up state of the two-side print sheet is controlled in said position A, but it may also be controlled by the number of print sheets transported to the two-side transport path 14*a*.

Furthermore, in the foregoing embodiment, the time $T_1$ added to the timer TA is determined according to the size of each print sheet, but it may also be varied in random manner or with a predetermined pitch according to the number of print sheets supplied to the two-side transport paths 14*a*, 14*b* even if the sheets are of a same size.

Furthermore, in the foregoing embodiment, the interval of the print sheets is determined according to the time $T_1$ added to the timer TA, but the interval may be determined for example by a timer provided in the transport path.

Furthermore, in the foregoing embodiment, the latching is conducted from the completion of sheet set-up to the completion of printing operation, it is also possible to set or reset the set-up completion state for example with a sensor, or to arbitrarily vary the latch timing.

Furthermore, in the foregoing explanation the interval of the print sheets is regulated due to a limitation in the intermediate tray 11*a* of the two-side unit 11, but the present invention is applicable also to a case where the sheet interval has to be regulated according to a limitation imposed by sheet discharge means outside the printer, for example a sorter connected to the printer.

Also the foregoing embodiment has been explained by a case of two-side printing, but it is naturally applicable also to a multiple print operation.

The above-explained embodiment, allowing to arbitrarily adjusting the interval of the sheet members supplied through the two-side transport paths, enables to improve the throughput and to achieve a continuous printing operation with the maximum throughput of the printer itself, even if the function of the two-side transport path is slower.

The present invention is not limited to the foregoing embodiments but is subject to various modifications within the scope and spirit of the appended claims.

What is claimed is:

1. A recording apparatus comprising:

recording means for recording an image on a recording material;

first storage means for storing the recording materials;

first feed means for feeding the recording material stored in said first storing means to a recording position of said recording means;

second storage means for storing the recording materials already subjected to image recording on a side thereof;

second feed means for feeding the recording material, which has been stored in said second storage means, again to said recording position;

detecting means for detecting the number of recording materials transferred toward said second storage means; and control means for controlling the interval of feeding of the recording materials by varying the feed timing of a succeeding recording material in accordance with the output of said detecting means.

2. A recording apparatus according to claim 1, capable of switching said first and second storage means during a continuous recording operation to feed the recording materials from one to another.

3. A recording apparatus according to claim 1, wherein said control means is adapted to delay said feed timing by a predetermined time, when the number of recording materials detected by said detector means reaches a predetermined value.

4. A recording apparatus according to claim 1 or 3, wherein said control means is adapted to advance said feed timing by a predetermined time, until the number of recording materials detected by said detector means reaches a predetermined value.

5. A recording apparatus comprising:

a recording unit, provided with recording means for recording an image on a recording material, and first feed means for feeding the recording material to a recording position of said recording means;

a process unit, provided with storage means for temporarily storing the recording materials, already bearing an image on a side thereof, and second feed means for re-feeding the recording materials stored in said storage means to record an image on said image-bearing side or on the opposite side, wherein said process unit may be attached to said recording unit; and control means for counting the number of recording materials transferred toward said storage means, and for controlling the interval of feeding of the recording materials by varying the feed timing of a succeeding recording material in accordance with the counting value.

6. A recording apparatus according to claim 5, wherein said control means is adapted to delay said feed timing by a predetermined time, when the number of recording materials detected by said detector means reaches a predetermined value.

7. A recording apparatus according to claim 5, wherein said control means is adapted to advance said feed timing by a predetermined time, until the number of recording materials detected by said detector means reaches a predetermined value.

8. A recording apparatus comprising:

recording means for recording an image on a recording material;

first feed means for feeding the recording materials to a recording position of said recording means;

second feed means for feeding the recording material, which was fed by said first feed means and subjected to an image recording on a side thereof, again to said recording position; and control means for controlling the feed timing of said first and second feed means for achieving mixed feeding of the recording materials by said first and second feed means;

wherein said control means varies the feed timing of a succeeding recording material depending upon which one of said first feed means or said second feed means the recording material was fed from.

9. A recording apparatus comprising:

recording means for recording an image on a recording material;

first feed means for feeding the recording materials to a recording position of said recording means;

second feed means for feeding the recording material, which was fed by said first feed means and subjected to an image recording on a side thereof, again to said recording position;

storage means for storing the recording materials discharged; and control means for controlling the feed timing of said first and second feed means for achieving mixed feeding of the recording materials by said first and second feed means;

wherein said control means varies the feed timing of a succeeding recording material depending upon which one of said second feed means and said storage means the recording material is to be transported to.

10. A recording apparatus comprising:

recording means for recording an image on a recording material;

first feed means for feeding the recording materials to a recording position of said recording means;

second feed means for feeding the recording material, which was fed by said first feed means and subjected to an image recording on a side thereof, again to said recording position;

discriminating means for discriminating that said second feed means comes into condition for allowance of re-feeding of the recording materials; and control means for controlling the feed timing of said first and second feed means for achieving mixed feeding of the recording materials by said first and second feed means in accordance with a discrimination result of said discriminating means.

11. An apparatus according to claim 10, wherein said discriminating means has counting means for counting the number of recording materials to be fed to said second feed means, and determines said second feed means to be in condition for allowance of re-feeding of the recording materials when said counting means has reached a predetermined counting value.

12. A recording apparatus comprising:

recording means for recording an image on a recording material;

first feed means for feeding the recording materials to a recording position of said recording means;

second feed means for feeding the recording material, which was fed by said first feed means and subjected to an image recording on a side thereof, again to said recording position;

detecting means for detecting the number of recording materials transported to said second feeding means; and control means for controlling said first and second feed means for achieving mixed feeding of the recording materials by said first and second feed means in accordance with a detecting output of said detecting means.

13. An apparatus according to claim 12, wherein said control means controls the feed timing of said first and second feed means.

* * * * *

UNITED STATES PATENT AND TRADEMARK OFFICE

CERTIFICATE OF CORRECTION

PATENT NO. : 4,853,740 Sheet 1 of 3

DATED : August 1, 1989

INVENTOR(S) : YUKIHIDE USHIO, ET AL.

It is certified that error appears in the above-identified patent and that said Letters Patent is hereby corrected as shown below:

COVER PAGE,

[63], Ser. No. 601,177" should read --001,177--.

COLUMN 2, line 5, "stand" should read --stands--;

line 16, "addition of" should read --addition to--;

line 20, "sheet" should read --sheets--;

line 64, "sown" should read --shown--.

COLUMN 3, line 35, "fed" should read --is fed--;

line 65, "intermediate tray." should read --intermediate tray lla.--.

COLUMN 4, line 25, "120" should read --121--;

line 27, "PRINT" should read --PRNT--;

line 28, "USREQ" should read --VSREQ--.

COLUMN 5, line 59, "explain" should read --explaining--.

COLUMN 7, line 42, "sheet" should read --sheets--.

UNITED STATES PATENT AND TRADEMARK OFFICE

CERTIFICATE OF CORRECTION

PATENT NO. : 4,853,740 Sheet 2 of 3

DATED : August 1, 1989

INVENTOR(S) : YUKIHIDE USHIO, ET AL.

It is certified that error appears in the above-identified patent and that said Letters Patent is hereby corrected as shown below:

COLUMN 8, line 10, "enable" should read --enabled--;

line 16, "not request" should read --no request--;

line 31, "time" should read --timer--.

COLUMN 9, line 41, "unit" should read --units--.

COLUMN 10, line 19, "to" should be deleted;

line 60, "detector" should read --detecting--;

line 65, "detector" should read --detecting--.

COLUMN 11, line 23, "detector" should read --detecting--;

line 29, "detector" should read --detecting--.

UNITED STATES PATENT AND TRADEMARK OFFICE

CERTIFICATE OF CORRECTION

PATENT NO. : 4,853,740 Sheet 3 of 3

DATED : August 1, 1989

INVENTOR(S) : YUKIHIDE USHIO, ET AL.

It is certified that error appears in the above-identified patent and that said Letters Patent is hereby corrected as shown below:

COLUMN 12, line 52, "detecting output" should read --detection output--.

Signed and Sealed this

Tenth Day of July, 1990

*Attest:*

HARRY F. MANBECK, JR.

*Attesting Officer*

*Commissioner of Patents and Trademarks*